US007373797B2

(12) United States Patent
Rosenberger

(10) Patent No.: US 7,373,797 B2
(45) Date of Patent: May 20, 2008

(54) METHOD FOR BENDING WORKPIECES

(75) Inventor: Gerhard Rosenberger, Gutenbach/Neueck (DE)

(73) Assignee: Rosenberger Ag, Apolda (DE)

( * ) Notice: Subject to any disclaimer, the term of this patent is extended or adjusted under 35 U.S.C. 154(b) by 0 days.

(21) Appl. No.: 10/567,067

(22) PCT Filed: Jul. 13, 2004

(86) PCT No.: PCT/EP2004/007730

§ 371 (c)(1),
(2), (4) Date: Mar. 13, 2006

(87) PCT Pub. No.: WO2005/016574

PCT Pub. Date: Feb. 24, 2005

(65) Prior Publication Data

US 2006/0254336 A1 Nov. 16, 2006

(51) Int. Cl.
*B21D 43/10* (2006.01)

(52) U.S. Cl. ..... 72/307; 72/422

(58) Field of Classification Search ..... 72/306, 72/307, 422, 424, 149, 388, 387
See application file for complete search history.

(56) References Cited

U.S. PATENT DOCUMENTS

| | | | | |
|---|---|---|---|---|
| 3,431,759 | A * | 3/1969 | Whittingham et al. | 72/405.09 |
| 4,989,444 | A * | 2/1991 | Murakami et al. | 72/422 |
| 5,182,936 | A | 2/1993 | Sartorio | |
| 5,187,958 | A | 2/1993 | Prunotto et al. | |
| 6,474,131 | B2 * | 11/2002 | Torvinen et al. | 72/461 |
| 6,694,794 | B2 * | 2/2004 | Crippa | 72/307 |
| 6,722,178 | B1 * | 4/2004 | Ito et al. | 72/420 |

FOREIGN PATENT DOCUMENTS

| | | |
|---|---|---|
| EP | 0554533 | 8/1993 |
| FR | 2747599 | 10/1997 |

* cited by examiner

*Primary Examiner*—Daniel C Crane
(74) *Attorney, Agent, or Firm*—Alleman Hall McCoy Russell & Tuttle LLP

(57) ABSTRACT

In a process for bending workpieces, particularly pipes, wires, bars, semi-finished products, sheet metal or the like, with at least one bending device, at least one robot is to pick up the workpiece to be shaped and feeds it to the at least one bending device for shaping, in particular bending.

20 Claims, 2 Drawing Sheets

METHOD FOR BENDING WORKPIECES

CROSS-REFERENCE TO RELATED APPLICATIONS

This is the national phase of PCT Application No. PCT/EP2004/007730 filed Jul. 13, 2004, which in turn claims priority to German Patent Application No. 10336554.0 filed Aug. 5, 2003, and also claims priority to German Patent Application No. 102004012771.9 filed Mar. 15, 2004, the entire disclosures of each of which are hereby incorporated by reference into the present application for all purposes.

The invention relates to a process for bending workpieces, particularly pipes, wires, bars, semi-finished products, sheet metal or the like, with at least one bending device.

In conventional processes for bending workpieces, a workpiece to be shaped is fed to a bending head of a bending machine by means of a feeding arrangement such as a cross slide, for example. The workpiece is picked up by a clamping device such as a collet chuck, for example, and is fed to the bending head by means of the cross slide. This process is disadvantageous because inserting the workpiece and arranging the workpiece on the bending device is time consuming.

Furthermore disadvantageous is that a conventional process for bending workpieces requires manual insertion into the bending device or bending machine. Removal and feeding of the workpieces to a final inspection is likewise primarily effected manually.

It is also known from the prior art that by means of a conventional robot, for example, workpieces can be loaded to a clamping device or collet chuck of a bending machine, said workpieces being subsequently completed in the bending machine. The scope of application of a bending machine is therefore limited.

Additionally, the workpieces must be bent or shaped in a bending machine. If other bending or shaping processes are necessary, the workpiece is fed to an additional bending device for further machining. This permits no precise final inspection of the bending state in the process.

The object of the present invention is to provide a process for bending workpieces, particularly pipes, wires, bars, semi-finished products, sheet metal or the like, that overcomes said disadvantages and with which workpieces can be quickly and economically shaped or bent in one production step and optionally an optimized final inspection can occur directly after the bending.

This object is achieved in that at least one robot picks up the workpiece to be shaped and feeds it to the at least one bending device for shaping, in particular bending.

In the present invention, the workpiece being picked up and fed, by means of a robot, to a bending unit comprising at least one bending device has proven particularly advantageous. Once in the bending device, the workpiece is then shaped or bent under continuous or batch feed by means of the robot.

The workpiece is directly picked up by the robot or a gripping arm of a robot and is directly fed to a bending head of the bending device. If required, the robot can correspondingly radially rotate the workpiece with the corresponding gripping arm. It is thereby possible to dispense with a conventional clamping device or a conventional clamp feed device.

After the bending of a certain region, the workpiece can be picked up by means of the robot or its gripping arm conversely to, for example, directly re-clamp said workpiece in the bending device or its bending head so as to machine, for example, another end of the workpiece. This is not possible in the conventional process.

The workpiece is removed by means of the robot from a supply bin and fed to the bending unit or the at least one bending device for shaping or bending. After the bending, the bent workpiece can be conveyed to a storage area. The robot then grips a new workpiece that is to be shaped or bent from the supply bin and feeds it continuously or batch-wise again to the at least one bending device. The robot arm, particularly its gripping device, can take over the continuous feeding and radial rotating of the workpiece in the bending unit during the bending process.

Roller bending heads, right-hand/left-hand bending heads, and bending devices with mandrel devices, folding devices or the like that are stationarily arranged with respect to a background can be combined as bending devices.

However, as part of the present invention, the bending device is also intended to be movable with respect to a background, in particular with respect to the robot. The at least one bending device can preferably be controlled manually and/or mechanically so as to move back and forth with respect to the robot on a cross slide, a track system, a linear system or the like in a direction or along a guide system with respect to the position of the robot, as indicated in dashed lines at 11.

A wide variety of workpieces of differing sizes or lengths can be machined in this manner with the present process. This would also make it possible for the robot to pick up very long pipes that could be bent in the bending device by the robot feeding the workpiece to be shaped directly to the bending heads of the bending device. This is likewise intended to be a part of the present invention.

A conveyor belt, a pick-up container, a machine such as a cutting unit or a transfer robot can serve as a supply bin that delivers or provides the workpiece to be shaped to the robot.

Subsequent to the shaping or bending of the workpiece, the robot then transfers the finished workpiece to a storage area, which can be a conveyor belt, a supply bin, a machine for additional processing, or a transfer robot, so as to feed the finished workpiece for a further processing step. The scope of the invention is not thereby limited.

In a further embodiment of the present invention, after the finishing of the workpiece the robot can feed the workpiece to a measuring device or guide the finished workpiece along the measuring device so that the complete contour of the finished workpiece can be recorded in three planes as a measured value and compared with a stored desired value. In this manner, a final inspection occurs automatically after the bending and shaping of the workpiece. If the workpiece does not correspond to the desired value or its tolerance range, re-bending can be effected by the robot feeding the workpiece anew to the bending unit for re-bending. Only subsequent to favorable re-inspection in the measuring device is the workpiece transferred to the storage area for further processing or machining.

The present invention is particularly advantageous in that a workpiece can very rapidly and fully-automatically be integrated in a production process by being removed from a supply bin, being shaped or bent in the bending unit or the at least one bending device, and, subsequent to successful intermediate inspection, by being optionally fed to a storage area. This enables the plant to save considerably on processing and manufacturing costs for the shaping and bending of workpieces.

Further advantages, features and details of the invention are evident from the following description of preferred embodiments as well as from the figures.

Figure 1:
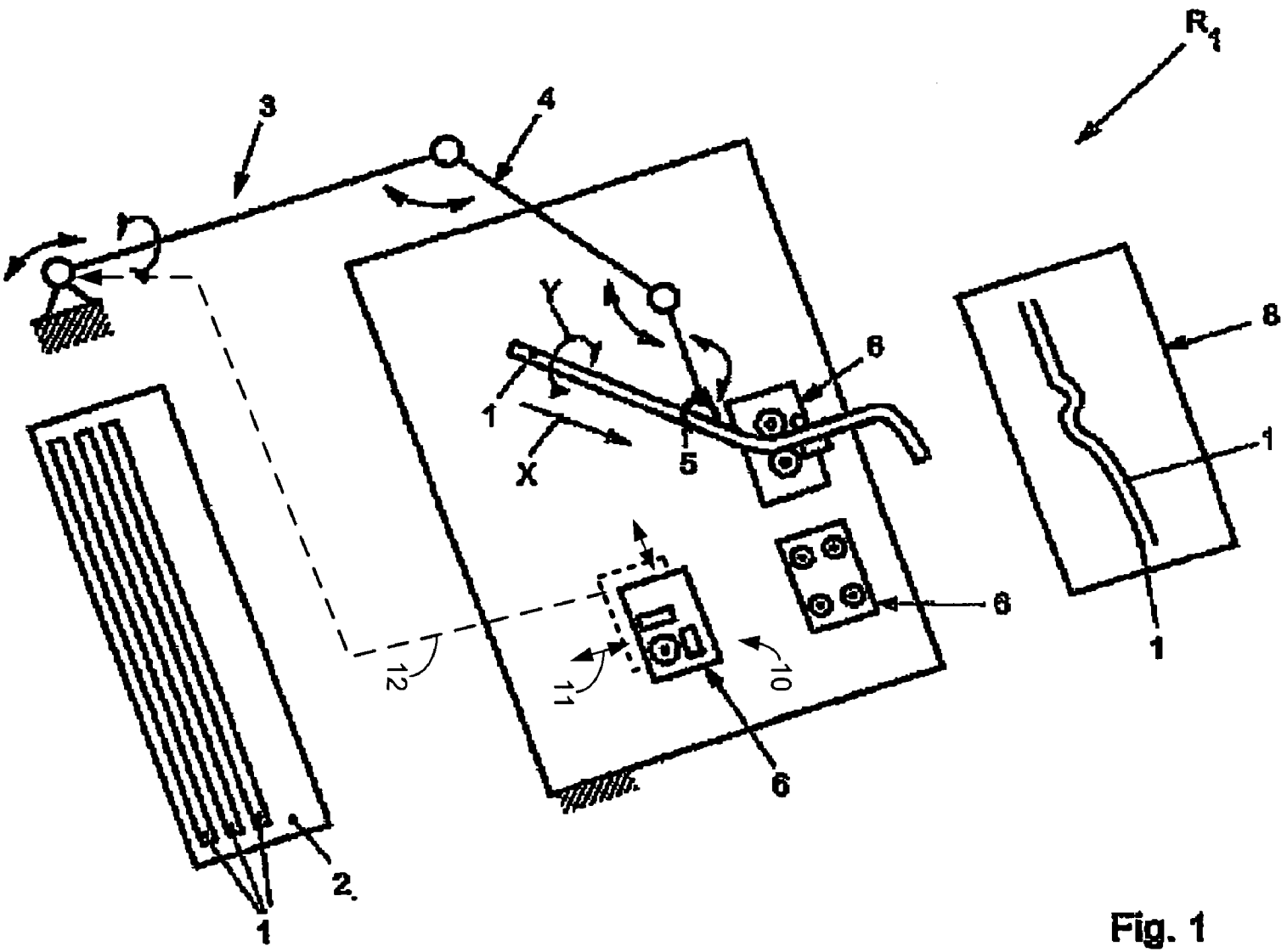
FIG. 1 shows a schematic top view of a station for bending workpieces.

According to FIG. 1, a claimed station $R_1$ for bending arbitrary workpieces (1) comprises a supply bin (2) in which a plurality of workpieces (1) is stored. A conveyor belt can also be used as the supply bin (2) containing a plurality of workpieces that optionally may have been pre-worked.

The supply bin (2) can also be a robot or similar conveying equipment that provides to station $R_1$ the workpieces (1) to be shaped or bent.

It is significant in the present invention that the station $R_1$ is provided with at least one robot (3). The robot (3) comprises a robot arm (4) partitioned into a plurality of sections with a terminal gripping device (5). The robot (3) grips with the gripping device the workpiece (1) to be shaped or bent and, after removing it from the supply bin (2), feeds it to the at least one bending device 6.

According to the requirement of the workpiece to be bent, a plurality of different types of bending heads (6) can be combined to form bending unit (7). The individual bending devices can, for example, be configured as roller bending heads, right-hand and/or left-hand bending heads, folding devices or the like so as to shape a workpiece in different ways.

It is important that in this process the feed is effected by the robot (3), in particular by the robot arm (4) and its terminally positioned gripping device (5), in the X-direction as indicated and that the rotating of the workpiece (1) about the workpiece axis is likewise effected in the Y-direction represented by the double arrow. The workpiece is fed by means of the robot (3) to the at least one bending device (6) of the bending unit (7) where it is bent and subsequently fed anew in the X-direction to the at least one bending device (6) so as to be bent anew. This results in the workpiece (1) being continuously advanced, by means of the robot (3), in the X-direction and/or radially rotated so that it can be shaped or bent in the Y-direction.

Preferably the robot only undertakes both the advancing function in the X-direction and the radial rotation of the workpiece (1) in the indicated Y-direction. In this manner, a workpiece (1) can be shaped, in particular bent, in three planes.

Optionally, during the bending process or while the workpiece (1) is clamped in the bending device (6), the robot (3) or its gripping device (5) can pick up the workpiece again at a different place in order to continue the bending process as described above.

After bending, the finished workpiece (1) is delivered by means of the robot (3) to a storage area (8) where it is stored. A conveyor belt, a transfer robot, a supply bin or the like can serve as said storage area (8). The scope of the invention is not thereby limited.

Figure 2:
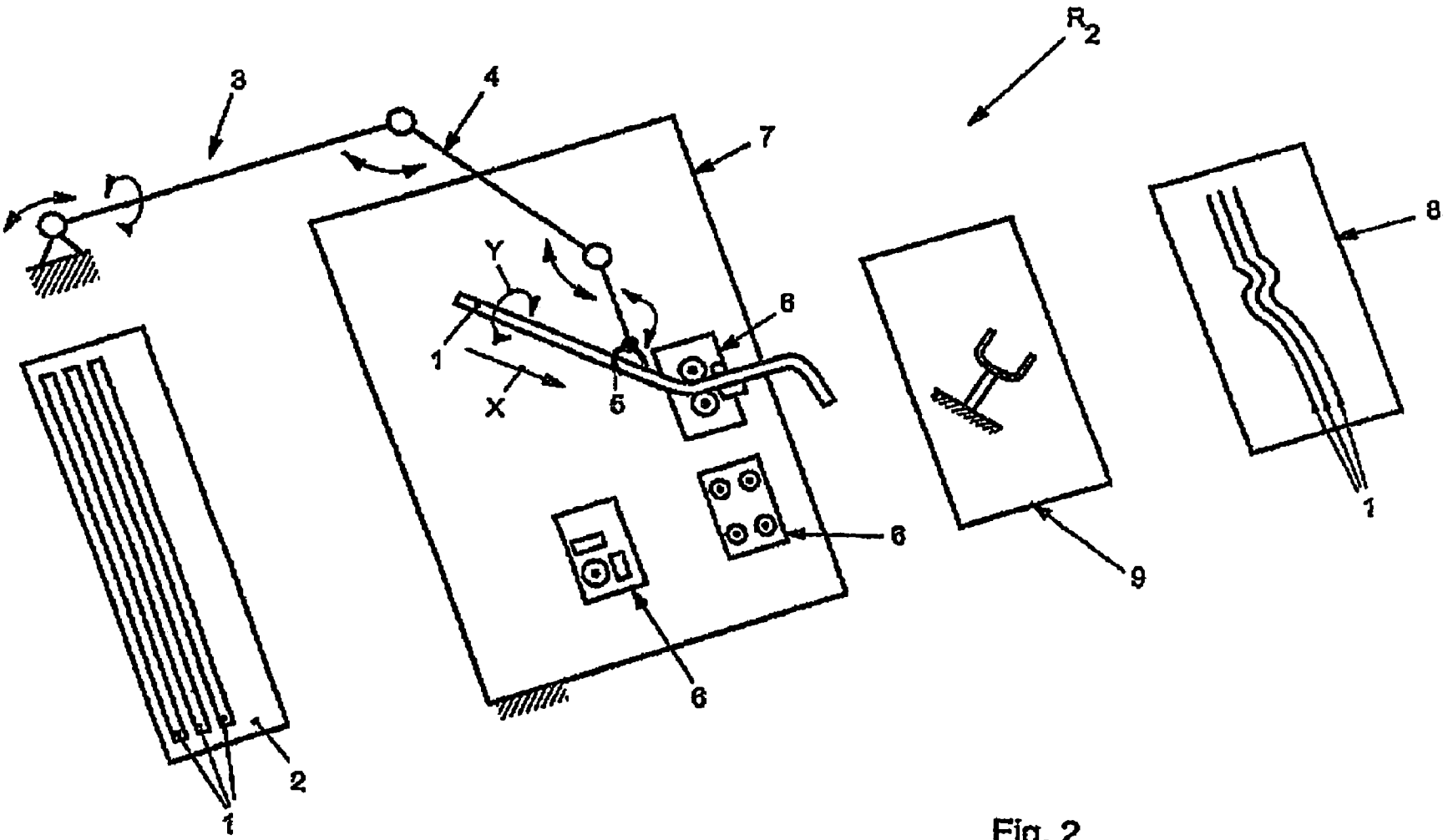
FIG. 2 shows a schematic view of the station according to FIG. 1 as a further embodiment.

In an embodiment of the present invention according to FIG. 2, a station $R_2$ is described that approximately corresponds to station $R_1$, the difference being that in the former, a measuring device (9) is interposed between the bending unit (7) and the storage area (8). Subsequent to shaping or bending, the finished bent or shaped workpiece (1) is removed from the bending unit (7) by means of the robot (3) and is guided along the measuring device (9), the bent contour of the workpiece (1) being moved over the measuring device (9). An intended state of the bent workpiece (1) is determined and compared with a stored measured value and/or tolerance zone. Should the measured value deviate impermissibly from the intended value, the workpiece (1) can be re-fed, by means of the robot (3), to the bending unit (7) for re-bending and adjustment bending. The bent or shaped workpiece (1) is then re-inspected in the measuring device (9). Only after the desired value and measured value agree is the bent or shaped workpiece (1) fed or transferred to the storage area (8).

ITEMIZED NUMBER LIST

| | |
|---|---|
| 1 | Workpiece |
| 2 | Supply bin |
| 3 | Robot |
| 4 | Robot arm |
| 5 | Gripping device |
| 6 | Bending device |
| 7 | Bending unit |
| 8 | Storage area |
| 9 | Measuring device |
| 10 | |
| 11 | |
| 12 | |
| 13 | |
| 14 | |
| 15 | |
| 16 | |
| 17 | |
| 18 | |
| 19 | |
| 20 | |
| 21 | |
| 22 | |
| 23 | |
| 24 | |
| 25 | |
| 26 | |
| 27 | |
| 28 | |
| 29 | |
| 30 | |
| 31 | |
| 32 | |
| 33 | |
| 34 | |
| 35 | |
| 36 | |
| 37 | |
| 38 | |
| 39 | |
| 40 | |
| 41 | |
| 42 | |
| 43 | |
| 44 | |
| 45 | |
| 46 | |
| 47 | |
| 48 | |
| 49 | |
| 50 | |
| 52 | |
| 52 | |
| 53 | |
| 54 | |
| 55 | |
| 56 | |
| 57 | |
| 58 | |
| 59 | |
| 60 | |
| 61 | |
| 62 | |
| 63 | |
| 64 | |

-continued

| | |
|---|---|
| 65 | |
| 66 | |
| 67 | |
| 68 | |
| 69 | |
| 70 | |
| 71 | |
| 72 | |
| 73 | |
| 74 | |
| 75 | |
| 76 | |
| 77 | |
| 78 | |
| 79 | |
| $R_1$ | Station |
| $R_2$ | Station |
| X | Direction |
| Y | Direction |

The invention claimed is:

1. A process for bending workpieces with at least one bending device and at least one robot, comprising picking up the workpiece to be shaped with the at least one robot and feeding it to the at least one bending device for shaping, the at least one bending device being arranged in a positionally fixed manner with respect to a surface and the at least one robot feeding continuously or batch-wise the workpiece for shaping to the at least one bending device or its bending heads, and the robot gripping the workpiece while feeding it into the at least one bending device during bending, and, for further bending, further feeding the workpiece to the at least one bending device and rotating the workpiece radially.

2. The process according to claim 1, wherein the workpieces comprise at least one workpiece selected from pipes, wires, bars, semi-finished products, and sheet metal.

3. The process according to claim 1, wherein the shaping comprises bending.

4. The process according to claim 1, wherein the robot continuously feeds the workpiece to the at least one bending device.

5. The process according to claim 1, wherein a robot arm picks up the workpiece and directly feeds it to the at least one bending device or directly to its bending head.

6. The process according to claim 5, wherein the robot arm comprises at least one gripping device of the at least one robot.

7. The process according to claim 5, wherein the robot arm feeds the workpiece batch-wise to the at least one bending device and the bending device shapes the workpiece at corresponding bending regions, and wherein during the shaping the robot arm picks up the workpiece by gripping it at any different place, including but not limited to in a finished region, to further feed the workpiece into the at least one bending device.

8. The process according to claim 1, wherein the at least one robot picks up the workpiece and feeds it to a plurality of bending devices for shaping different radii, bends, and/or angles, the workpiece being radially rotatable in the gripping device.

9. The process according to claim 8, wherein the bending devices comprise roller bending heads, right-hand/left-hand bending heads, bending devices with mandrel devices,with mandrel devices, and folding devices.

10. The process according to claim 1, wherein the at least one robot removes the workpiece from a supply bin, feeds it to the bending device for shaping or bending and subsequent to bending to a storage area for further machining, said robot again picking up a workpiece to be shaped or bent from the supply bin.

11. The process according to claim 1, wherein the workpiece is delivered to another robot, a conveyor belt, a machine, or a storage area for further machining.

12. The process according to claim 1, wherein the robot picks up the workpiece and directly feeds said workpiece in selectable regions that are to be shaped to the bending device or its bending heads, removes said workpiece subsequent to shaping, and feeds other regions or end parts of the workpiece for further machining or shaping, after complete processing of the workpiece the robot supplies the workpiece for delivery or additional processing.

13. The process according to claim 1, wherein the bending unit can be manually and/or automatically moved with respect to the position of the robot.

14. The process according to claim 1, wherein the bending unit comprises a bending device.

15. The process according to claim 14, wherein the bending unit can automatically or with a cross slide travel a linear system in a selectable direction or along a selectable guide system with respect to the position of the robot, the corresponding position coordinates being transferred to the robot.

16. A process for bending workpieces with at least one bending device and at least one robot arm, the process comprising:

picking up the workpiece to be shaped with the at least one robot arm and feeding it to the at least one bending device for shaping, the at least bending device being arranged in a positionally fixed manner with respect to a surface; and the at least one robot arm feeding continuously or batch-wise the workpiece for shaping to the at least one bending device or its bending heads, and the robot gripping the workpiece while feeding it into the at least one bending device during bending, and for further bending, feeding it anew to the at least one bending device and rotating the workpiece radially, wherein subsequent to the shaping or bending of a workpiece, said workpiece is guided by the at least one robot along a measuring device so as to detect the shapes or bends as a desired value, a process inspection being conducted upon comparison of said desired value with a stored and selected desired value and optionally a re-shaping or re-bending being effected by means of the robot re-feeding the workpiece to the at least one bending device.

17. The process according to claim 16, wherein subsequent to re-bending or re-shaping, the workpiece is re-fed, by means of the robot, to the measuring device and only after there is agreement between the desired value and measured value or with the predetermined tolerance ranges is the workpiece fed to the storage area or to further machining.

18. A process for bending workpieces with at least one bending device and at least one robot arm of a robot, the at least one bending device being arranged in a positionally fixed manner with respect to a surface, the process comprising:

picking up the workpiece to be shaped with the at least one robot arm feeding the workpiece to the at least one bending device for shaping, wherein the at least one robot arm grips the workpiece while feeding it continuously into the at least one bending device during bending; and feeding the workpiece again to the at least one bending device with the at least one robot arm for further bending.

19. The process of claim 18, further comprising rotating the workpiece radially with the at least one robot arm.

20. The process of claim 18, wherein the at least one robot arm feeds the workpiece to the at least one bending device in at least one of a batch-wise manner and a continuous manner.

* * * * *